US008870629B2

(12) United States Patent
Comstock et al.

(10) Patent No.: US 8,870,629 B2
(45) Date of Patent: Oct. 28, 2014

(54) ERGONOMIC SANDING BLOCK

(75) Inventors: Matthew S. Comstock, Loveland, CO (US); Kyle Davis, Overland Park, KS (US); Weng Po Hsien, Dongguan (CN)

(73) Assignee: L.A.D. Global Enterprises, Inc., Olathe, KS (US)

( * ) Notice: Subject to any disclaimer, the term of this patent is extended or adjusted under 35 U.S.C. 154(b) by 208 days.

(21) Appl. No.: 13/451,680

(22) Filed: Apr. 20, 2012

(65) Prior Publication Data

US 2012/0270482 A1 Oct. 25, 2012

Related U.S. Application Data

(60) Provisional application No. 61/477,239, filed on Apr. 20, 2011.

(51) Int. Cl.
*B24D 15/02* (2006.01)

(52) U.S. Cl.
CPC ..... *B24D 15/023* (2013.01)
USPC ..... 451/525; 451/524

(58) Field of Classification Search
CPC ..... B24D 15/00; B24D 15/02; B24D 15/023
USPC ..... 451/523, 524, 525
See application file for complete search history.

(56) References Cited

U.S. PATENT DOCUMENTS

| | | | | | |
|---|---|---|---|---|---|
| 840,982 | A | * | 1/1907 | Williams | 451/492 |
| 1,599,906 | A | * | 9/1926 | McKnight | 451/503 |
| 2,457,076 | A | * | 12/1948 | Williams, Jr. et al. | 451/522 |
| D152,607 | S | * | 2/1949 | Gerlinger | D8/90 |
| 2,527,089 | A | * | 10/1950 | Adams | 451/515 |
| 2,657,508 | A | * | 11/1953 | Schubert | 451/515 |
| 2,765,593 | A | | 10/1956 | Salmon et al. | |
| 3,175,334 | A | * | 3/1965 | Price et al. | 451/525 |
| 4,221,084 | A | * | 9/1980 | Frantzen | 451/503 |
| 4,885,876 | A | * | 12/1989 | Henke | 451/503 |
| 4,918,871 | A | * | 4/1990 | Widmann | 451/461 |
| 5,168,672 | A | * | 12/1992 | Gregoire, Sr. | 451/502 |
| 5,279,080 | A | * | 1/1994 | Muller et al. | 451/525 |
| D365,507 | S | | 12/1995 | Pope | |
| D377,305 | S | * | 1/1997 | Bliss | D8/90 |
| D406,515 | S | | 3/1999 | Ali | |
| 6,261,031 | B1 | * | 7/2001 | Stipe et al. | 407/29.15 |
| 6,296,558 | B1 | * | 10/2001 | Poole et al. | 451/557 |
| RE37,486 | E | * | 12/2001 | Stanzione | 451/523 |
| 7,144,300 | B1 | * | 12/2006 | Cybulski et al. | 451/28 |
| 2007/0155297 | A1 | * | 7/2007 | Cybulski et al. | 451/523 |
| 2007/0212989 | A1 | * | 9/2007 | Henke et al. | 451/344 |

* cited by examiner

*Primary Examiner* — Lee D Wilson
*Assistant Examiner* — Tyrone V Hall, Jr.
(74) *Attorney, Agent, or Firm* — Erickson Kernell Derusseau & Kleypas, LLC

(57) ABSTRACT

A two-piece sanding block presents base and handle/grip components. The base presents a flat surface for extension of a strip of sandpaper or other abrasive material therealong. Prongs extending from the base pierce the ends of the strip. The prongs seat within the handle and cooperate with a post which seats in the base for precluding slippage between the base and handle during the sanding process. Upon placing the handle atop the base the strip is further held in place. The top surface of the handle presents a particularly configured arch-like surface for complementing the fingers and palm of the user in an ergonomic fit therebetween.

20 Claims, 5 Drawing Sheets

ERGONOMIC SANDING BLOCK

CROSS REFERENCE TO RELATED APPLICATION

This application claims the benefit of application Ser. No. 61/477,239, filed Apr. 20, 2011, entitled ERGONOMIC SANDING BLOCK.

BACKGROUND OF THE INVENTION

This invention relates to a block for supporting abrasive sheet material thereon and, more particularly, to an ergonomically designed block which securely holds the material in place during the sanding process.

Prior known sanding blocks have arisen with basic design configurations that either have abrasive material, e.g., sandpaper, permanently or releasably attached thereto. Problems have arisen as the sandpaper becomes dislodged during the sanding process. Also, the block configuration itself is not ergonomically conducive to improved sanding. In turn, we have invented a two-piece sanding block that not only releasably secures the sandpaper therein but also presents a pleasing ergonomic design to enhance sanding.

Briefly the present invention presents base and upper handle components. The base is configured so as to present a flat sanding surface with a strip of sandpaper releasably secured thereto. Upon such placement the handle is firmly attached to the base so as to preclude relative movement therebetween. The top surface of the base complements the bottom surface of the handle in a contiguous relationship therebetween which assures that the sandpaper strip remains in place during the sanding process. The releasable components allow for efficient loading of the sandpaper. Prong/aperture and post/aperture combinations also preclude slippage of the components during the sanding process.

Accordingly, it is a general object of this invention to provide a tool, which ergonomically and functionally enhances the sanding process.

A further object of this invention is to provide a tool, as aforesaid, which firmly secures a replaceable sandpaper strip for subsequent sanding.

Another object of this invention is to provide a tool, as aforesaid, which precludes shifting of the sandpaper during the sanding process.

Still another particular object of this invention is to provide a tool, as aforesaid, which presents a base component and a grip handle component releasably secured to the base.

A still further object of this invention is to provide a tool, as aforesaid, wherein the contiguous surfaces of the base and grip components complement one another to preclude movement therebetween during the sanding process.

Another particular object of this invention is to provide a tool, as aforesaid, which precludes slippage between the base and handle during sanding.

A still further particular object of this invention is to provide a tool, as aforesaid, wherein the exterior surface of the grip component is ergonomically configured to enhance the user's grip thereon during the sanding process.

Another particular object of this invention is to provide a tool, as aforesaid, wherein the grip component presents depending lugs for positive engagement with apertures found in the base.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 1:
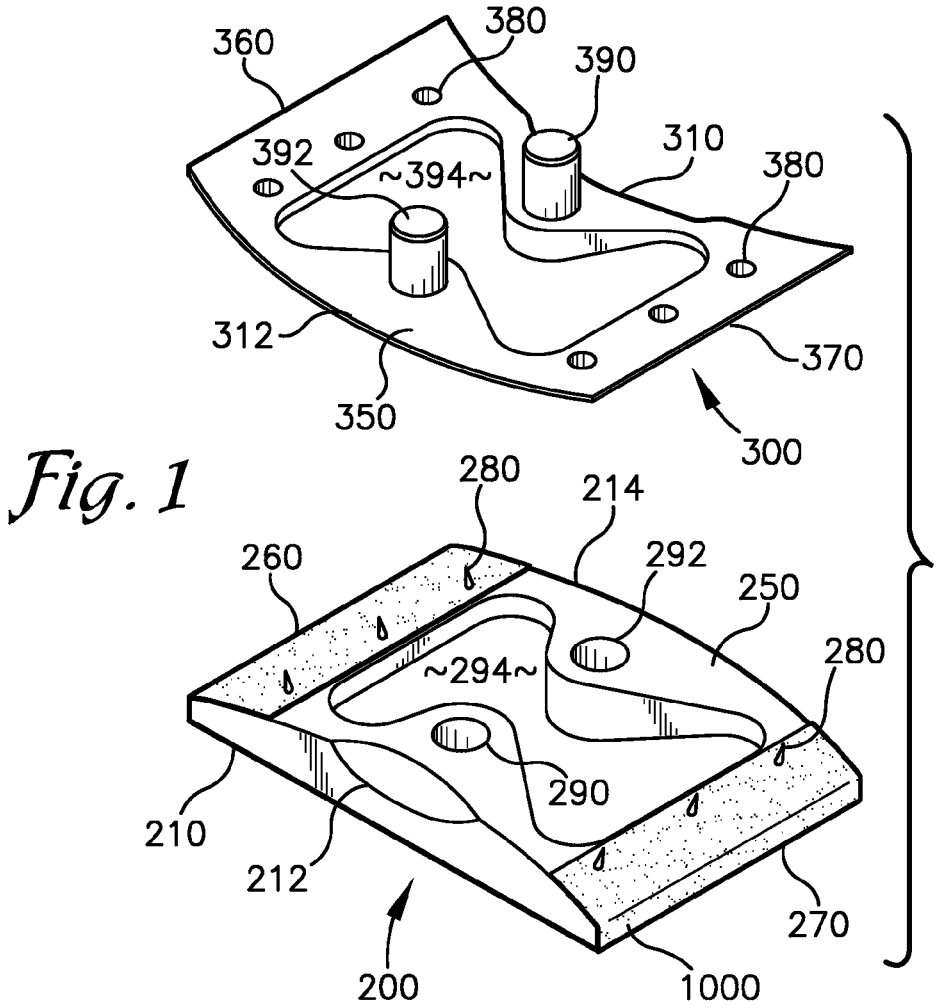
FIG. 1 is an exploded, perspective view of the two-part sanding tool with the upper grip component being rotated 180 degrees to show the underlying structure therein.

Turning more particularly to the drawings, FIG. 1 shows the block 100 in the form of a lower base 200 and a top handle 300 or grip component.

Figure 9:
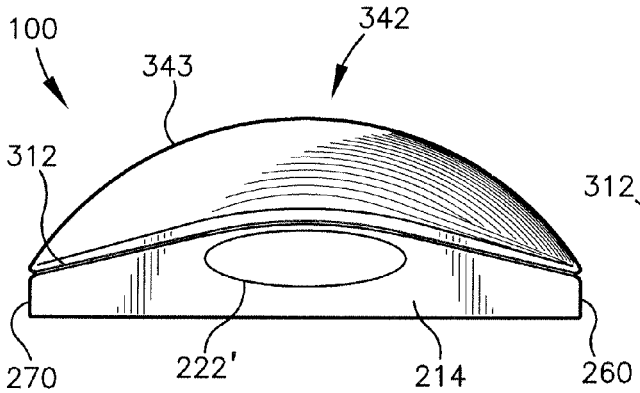
FIG. 9 is a rear view of the sanding block shown in FIG. 8.

The base 200 presents a flat, bottom surface 210 and an opposing curved top surface 250. Extending from the top surface 250, adjacent the opposing end walls 260, 270 thereof, are a plurality of upstanding prongs 280. Within the top surface 250 are spaced-apart apertures 290, 292 with a recess 294 extending therebetween. The base 200 includes a pair of congruent longitudinal sidewalls 212, 214 extending between the base ends 260, 270. The maximum height of each arch-like sidewall 212, 214 occurs at the midpoint thereof designated as 240. Along sidewall 212 at the center point thereof is a semi-circular recess 222 Recess 222' is found in sidewall 214 (FIG. 9).

The upper component of the block 100 presents a handle 300 or grip. This component includes a bottom surface 350 and a top surface 352 presenting an arch-like configuration. Depending from the bottom surface 350 is a pair of spaced-apart posts 390, 392 adapted to fit within the apertures 290, 292 in base 200. Likewise the bottom surface 350 presents a recess 394, congruent with recess 294, extending between posts 390, 392. A plurality of apertures 380 extend along the ends of the bottom surface 350. These apertures are designed to receive the underlying prongs 280 therein. Along the sidewall 310 of the grip component is a recess 322, which aligns with the recesses 222 when grip 300 engages the base 200.

In use, the sandpaper strip 1000 is placed congruent to the bottom surface 210 of the base 200 in a contiguous fit therealong. The ends of the sandpaper strip 1000 are wound about the ends 260, 270 of the base for extension of the prongs 280 therethrough. Subsequently, the handle portion is fitted atop the base such that the depending posts 390, 392 seat within the underlying apertures 290, 292. Concurrently, the upstanding prongs 280 seat within the apertures 380 found along the surface 350 of the curvilinear surface 350 of the handle 300.

Upon such reception the arch-like surfaces 250, 350, being complementary in configuration, are in a contiguous fit therebetween. Likewise, the recesses 222, 232 are aligned so as to present a full seat for the thumb of the use. This contiguous relationship, as well as the seating of the posts 390, 392 within apertures 290, 292 and prongs 280 within apertures 380, assures that there is no relative movement between the base 200, 300. These relationships assure that the sandpaper stays in place during the sanding process.

Figure 2:
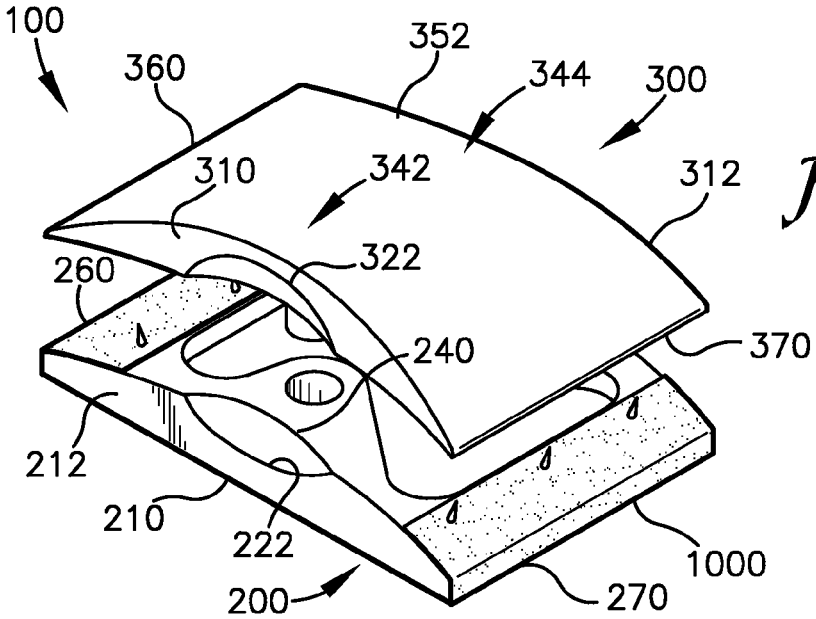
FIG. 2 is a perspective view of the sanding block showing the base and grip components prior to engagement.
Figure 3:
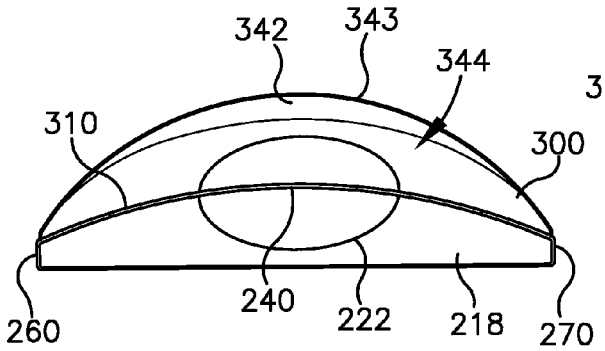
FIG. 3 is a side view of the sanding block in FIG. 2 showing the block components in full engagement, as well as the ascending slope of the upper surface of the grip.
Figure 4:
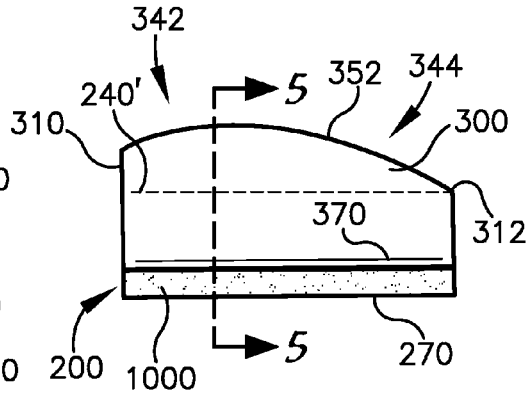
FIG. 4 is an end view of the block of FIG. 3 and showing the high portion of the top surface of the block on the left side thereof.
Figure 5:
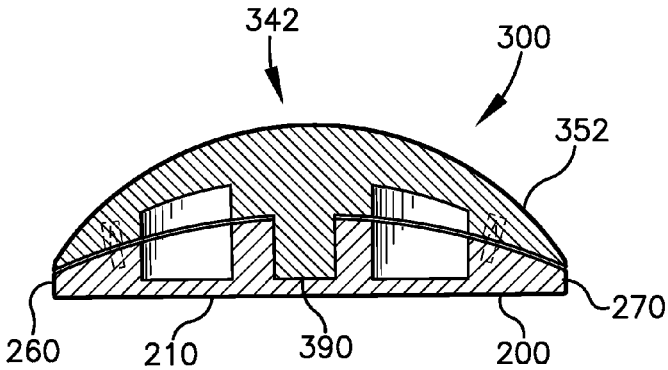
FIG. 5 is a sectional view of the block, as taken along line 5-5 in FIG. 4, and showing the engagement of one of the depending posts of the grip with a corresponding aperture in the base of the block.
Figure 6:
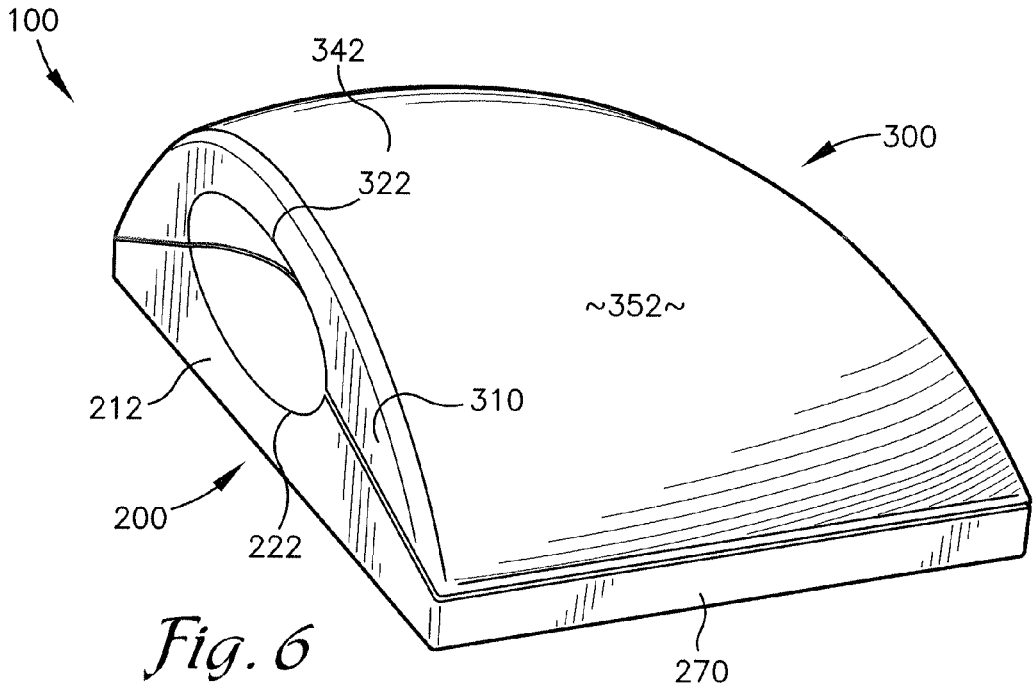
FIG. 6 is a perspective view of the sanding block of FIG. 2 on a larger scale.
Figure 10:
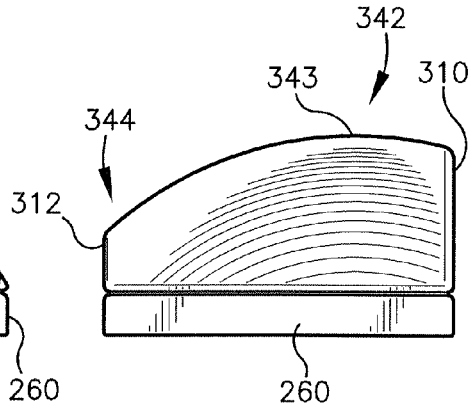
FIG. 10 is a right side view of the sanding block shown in FIG. 9.
Figure 11:
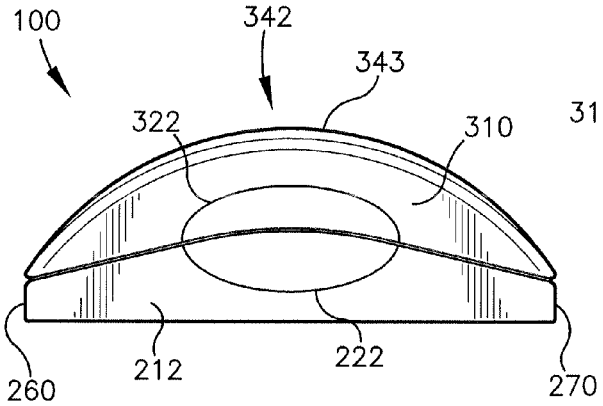
FIG. 11 is a right side view of the sanding block shown in FIG. 10, or as shown in FIG. 3, on a larger scale.
Figure 12:
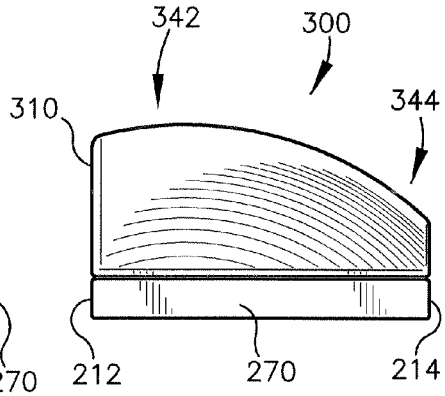
FIG. 12 is a right side view of the sanding block shown in FIG. 11, or as shown in FIG. 4 on a larger scale.
Figure 13:
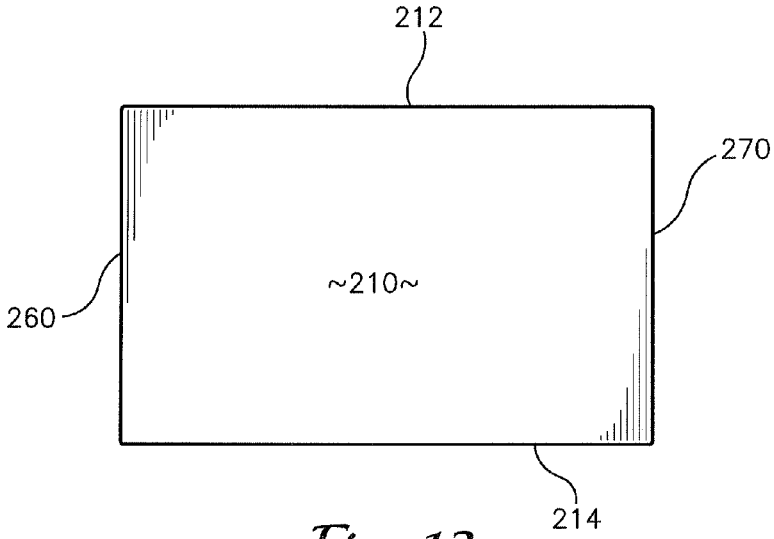
FIG. 13 is a bottom view of the sanding block shown in FIG. 6.

The contour of the top surface 352 of handle 300 is configured to present an ergonomic fit so as to complement the contour of the fingers and underlying palm of the user when grasping the handle 300. The portion 342 of the surface 352 adjacent handle sidewall 310 is designed to underlie the index finger and fingers adjacent thereto. This portion 342 is higher than the portion 344 of the surface 352 which is adjacent sidewall 312 (FIGS. 4, 10). This lower portion 344 is designed to underlie the little finger and fingers adjacent thereto as viewed from the end wall 270 (FIG. 4). As best shown in FIGS. 4, 10 and 12, the top surface 352 at sidewall 310 initially presents an arch-like configuration as it longitudinally extends between the ends 360, 370 of handle 300. The maximum height of this arch-like configuration occurs in the region above the recesses in the base and handle sidewalls. As best shown in FIGS. 4, 10 and 12, the radius of the arch-like surface 352, relative to base 210, initially slightly increases as the surface 352 laterally extends away from sidewall 310 until it reaches a point about one-third the width of the block handle 300 as measured between the sidewalls 310, 312. FIG. 9 shows the maximum arch-like height as contour line 343. At this area, the arch radius successively decreases until the minimum radius is reached at sidewall 312. Thus, the thickness of sidewall 310 (FIG. 2) is greater than the thickness of sidewall 314 (FIG. 1). Hidden line 240' in FIG. 4 designates the high point of the arch-like surface 250 longitudinally extending between sidewalls 210, 212. The difference in heights of sidewalls 310, 312 relative to this high point 240 of surface 250 of base 200 is thus shown. This configuration of surface 352 thus presents a higher arch-like region 342 of the block handle 300, laterally extending away from adjacent sidewall 310, followed by a decreasingly sloping surface or arch-like region 344 as it laterally extends away from region 342 and approaches end wall 312, as best seen in FIGS. 4, 10 and 12.

Figure 7:
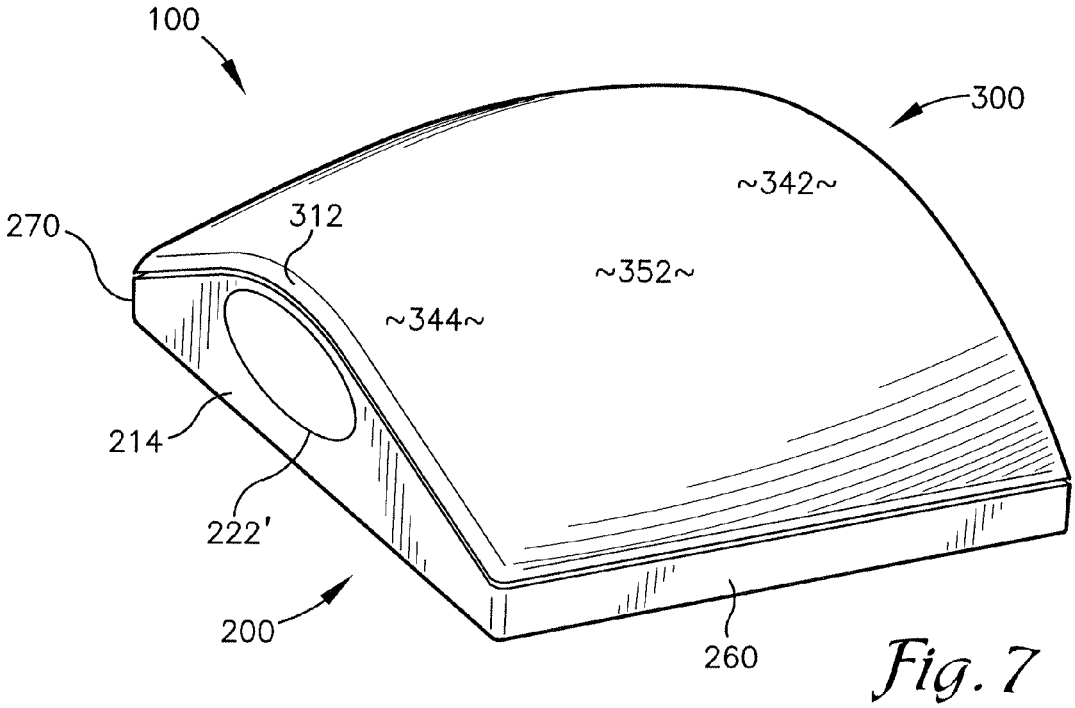
FIG. 7 is a perspective view of the sanding block in FIG. 7 rotated 180 degrees.
Figure 8:
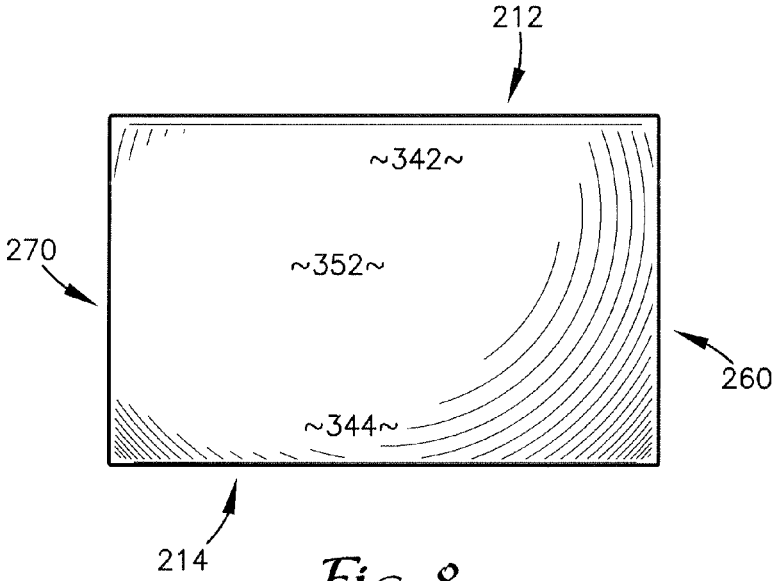
FIG. 8 is a top view of the sanding block shown in FIG. 7.

Upon gripping, the thumb of the user is seated within the recess 222, 322 combination with the fingers extending towards end 260. The higher side 342 of the handle surface 352 is thus contiguous with the palm and underlies the index finger and adjacent fingers with the lower side 344 of handle surface 352 contiguous with the palm and underlies the little finger or index finger and fingers adjacent thereto. Thus, the middle finger of the user's hand extends along the region 343 corresponding to the maximum height of the arch-like surface extending between the end walls 260, 270. The little finger may seat within recess found in sidewall 214 (FIG. 7).

It is noted that when the arm is extended and the hand is relaxed the hand tends to rotate away from the midline of the body such that the outside portion of the palm is lower than the inside palm portion adjacent the index finger/thumb combination. Thus, surface 352 presents an ergonomic design which complements this natural contour of the fingers and palm of the hand when grasping the handle 300 as the high side 342 of the surface 352 is against the higher portion of the palm underneath the middle finger/index finger/thumb combination with the lower portion 344 of the surface adjacent the lower palm portion underneath the little finger and fingers adjacent thereto. These relationships assure that efficient forces can be applied to the sand paper as captured between the base 200 and handle 300.

It is noted that the above has been described for a right-handed user. A left-handed user can also utilize the same block such that the fingers extend towards base end 270 with thumb seated in the aligned recesses 222, 322.

It is to be understood that while certain now preferred forms of this invention have been illustrated and described, it is not limited thereto except insofar as such limitations are included in the following claims.

Having thus described the invention, what is claimed as new and desired to be secured by Letters Patent is as follows:

1. A tool adapted to hold abrasive material comprising:

a base having a top surface and a planar bottom surface for extension of a strip of abrasive material therealong;

a pair of opposed end walls normal to said bottom surface of said base;

a pair of sidewalls extending between said base end walls;

a plurality of prongs extending from said top surface of said base, said prongs adapted to extend through the ends of the strip of abrasive material overlapping said base end walls and extending along said bottom surface of said base;

a releasable handle having a top surface and a bottom surface extending between a pair of opposed end walls;

a pair of opposed handle sidewalls extending between said handle end walls, one handle sidewall having a greater height than an opposed handle sidewall above said base, said bottom surface of said handle having a configuration complementary to said top surface of said base to present a contiguous fit therebetween;

means for receiving said prongs of said base within said handle with the abrasive material ends in a contiguous fit between said handle bottom surface and said base top surface;

said handle top surface comprising a contoured surface, said contoured surface presented by an arch-like surface longitudinally extending between said opposed end walls of said handle, said arch-like surface presenting a first laterally extending portion increasing in height, relative to said base, as said top surface laterally extends from one handle sidewall to said opposed handle sidewall to a region on said handle top surface displaced from said one handle sidewall, said arch-like surface then presenting a second laterally extending portion successively decreasing in height relative to said base, as said arch-like surface laterally extends from said region to said opposed handle sidewall, said first laterally extending portion of said arch-like surface at a greater height, relative to said base, adjacent said one handle sidewall than the height of said second laterally extending portion of said arch-like surface adjacent said opposed handle sidewall, said greater height of said first laterally extending portion adjacent said one handle sidewall adapted to be contiguously positioned underneath the index finger and adjacent fingers of a user with said height of said second laterally extending portion adjacent said opposed sidewall adapted to be contiguously positioned underneath the ring finger and adjacent fingers of a user grasping said handle.

2. The tool as claimed in claim 1 wherein said prong receiving means comprises a plurality of apertures in said handle bottom surface, said prongs projecting into said apertures with the abrasive material between said handle bottom surface and base top surface.

3. The tool as claimed in claim 2 further comprising:

at least one post extending from said bottom surface of said handle;

a post aperture in said top surface of said base, a reception of said at least one post in said post aperture precluding slippage between said handle and said base.

4. A tool adapted to hold abrasive material comprising:

a base having a top surface and a bottom surface for extension of a strip of abrasive material having a pair of opposed ends therealong;

a pair of opposed end walls extending from said bottom surface of said base;

a pair of sidewalls longitudinally extending between said opposed end walls;

a releasable handle having a top surface for grasping by a user and a bottom surface extending between a pair of opposed end walls;

a pair of sidewalls longitudinally extending between said handle end walls, said bottom surface of said handle having a configuration complementary to said top surface of said base to present a fit therebetween with the pair of opposed ends of the abrasive material therebetween, said top surface of said handle presenting an arch-like configuration longitudinally extending between said handle end walls, said arch-like configuration of said handle top surface having a greater height, relative to said base, adjacent one sidewall of said pair of handle sidewalls than a height relative to said base, of said arch-like configuration adjacent the other sidewall of said pair of handle sidewalls, whereby said top surface of said handle presents a fit complementary to the hand of a user grasping said handle.

5. The tool as claimed in claim 4 further comprising a plurality of prongs extending from said top surface of said base, said prongs adapted to extend through ends of the strip of abrasive material positioned between said base top surface and said bottom surface of said handle.

6. The tool as claimed in claim 5 further comprising means for receiving said prongs within said handle with a portion of abrasive material in a contiguous fit between said handle and said base.

7. The tool as claimed in claim 6 further comprising means for precluding slippage between said handle and said base upon a grasping of said handle by a user.

8. The tool as claimed in claim 5 wherein said prong receiving means comprises a plurality of apertures in said handle bottom surface, said prongs projecting into said apertures with the abrasive material between said handle bottom surface and base top surface.

9. The tool as claimed in claim 7 wherein said slippage precluding means comprises:

at least one post extending from said bottom surface of said handle;

at least one post aperture in said top surface of said base, a reception of said at least one post in a corresponding said at least one post aperture precluding slippage between said handle and said base.

10. A tool adapted to hold abrasive material comprising:

a base having a top surface and a bottom surface for extension of a strip of abrasive material therealong;

a pair of opposed end walls extending from said bottom surface of said base;

a pair of sidewalls extending between said end walls;

a handle having a top surface for grasping by a user and a bottom surface, said top and bottom surfaces of said handle longitudinally extending between a pair of opposed end walls;

first and second opposed sidewalls extending between said handle end walls, said bottom surface of said handle having a configuration complementary to said top surface of said base to present a fit therebetween;

said handle top surface comprising an arch-like surface longitudinally extending between said opposed end walls of said handle, said arch-like surface presenting a higher portion of said handle top surface, relative to said base bottom surface, at a first region adjacent said first handle sidewall than a height of a second lower portion at a second region adjacent said second handle sidewall, said higher portion adapted to bear against at least the index finger and adjacent finger of the user grasping said handle.

11. The tool as claimed in claim 10 further comprising:

a plurality of prongs extending from said top surface of said base for extension through ends of the strip of abrasive material extending along said bottom surface of said base;

a plurality of apertures in said handle for receiving said prongs therein with the abrasive material ends between said handle and said base.

12. The tool as claimed in claim 10 further comprising:

at least one post extending from said bottom surface of said handle;

at least one aperture in said top surface of said base, a reception of said at least one post in said at least one corresponding aperture precluding slippage between said handle and said base.

13. The tool as claimed in claim 10 wherein said higher portion of said top surface successively increases in height from said first handle sidewall to a distance approximate one-third a distance between said first and second handle sidewalls.

14. The tool as claimed in claim 10 wherein said arch-like surface successively increases in height in a lateral extension from said first handle sidewall and then successively decreases in height in a lateral extension towards said second handle sidewall whereby to present said higher portion of said arch-like top surface at said first region adjacent said first handle sidewalls and said lower portion of said arch-like top surface at said second region adjacent said second handle sidewall.

15. The tool as claimed in claim 10 wherein said higher portion at said first region of said handle top surface is adapted to bear against a palm of a user grasping said top surface.

16. The tool as claimed in claim 10 wherein said lower second portion at said second region of said handle top surface is adapted to bear against at least a little finger of a user grasping said handle top surface.

17. The tool as claimed in claim 14 handle wherein said higher portion at said first region of said handle top surface is adapted to bear against a palm of a user grasping said top surface.

18. The tool as claimed in claim 14 wherein said lower second portion at said second region of said handle top surface is adapted to bear against at least a little finger of a user grasping said top surface.

19. The tool as claimed in claim 10 wherein a maximum height of said arch-like surface is positioned midway between said pair of opposed handle end walls.

20. The tool as claimed in claim 10 wherein a maximum height of said arch-like surface is positioned approximately one-third a distance between said opposed sidewalls of said handle.

* * * * *